US005169033A

United States Patent [19]

Shay

[11] Patent Number: 5,169,033

[45] Date of Patent: Dec. 8, 1992

[54] CONTAINER-CLOSURE ASSEMBLY INCLUDING A SCREW-CAP HAVING ANTI-BACKOFF TEETH ON ITS THREADS

[75] Inventor: Joseph J. Shay, Waterbury, Conn.

[73] Assignee: Specialty Packaging Licensing Company, Inc., Wilmington, Del.

[21] Appl. No.: 791,124

[22] Filed: Nov. 13, 1991

[51] Int. Cl.[5] ..... B67B 5/00; B65D 83/14

[52] U.S. Cl. ..... 222/153; 215/330; 215/216

[58] Field of Search ..... 222/153, 321, 383, 549, 222/562; 215/329-331, 216, 217, 220, 274, 276

[56] References Cited

U.S. PATENT DOCUMENTS

| | | | |
|---|---|---|---|
| 2,162,880 | 6/1939 | Brown | 215/330 |
| 3,511,403 | 5/1970 | Braun | 215/330 |
| 4,053,077 | 10/1977 | De Felice | 215/217 |
| 4,084,716 | 4/1978 | Bogert | 215/217 |
| 4,345,691 | 8/1982 | Burke | 215/330 X |
| 4,366,921 | 1/1983 | Kirk, Jr. | 222/153 |
| 4,461,394 | 7/1984 | Sendel et al. | 215/330 |
| 4,697,715 | 10/1987 | Beruvides | 215/330 |

*Primary Examiner*—Kevin P. Shaver
*Assistant Examiner*—Kenneth DeRosa
*Attorney, Agent, or Firm*—Dallett Hoopes

[57] ABSTRACT

A container-closure assembly comprises a container molded of relatively soft plastic and a closure cap molded of relatively hard plastic and having a top wall and a continuous side wall. Threads are formed on both the finish of the container and inward on the side wall of the cap. The threads on the cap comprise three threaded segments spaced about the inner circumference of the side wall. The segments include an inward upwardly sloping rib, the upper surface of which is formed with a plurality of wedge-shaped teeth. In use, the closure is screwed on to the top of the container finish and the teeth dig onto the underside of the threads on the finish causing the instantaneous elastic deformation of the plastic of the finish to anchor the cap against removal.

4 Claims, 1 Drawing Sheet

CONTAINER-CLOSURE ASSEMBLY INCLUDING A SCREW-CAP HAVING ANTI-BACKOFF TEETH ON ITS THREADS

BACKGROUND OF THE INVENTION

1. Field of the Invention

This invention relates to container-closure assemblies wherein the threads of the closure are provided with teeth to resist the backing off of the closure once the closure is properly screwed onto the finish of the container.

2. Description of Related Art including Information Disclosed under §§1.97 to 1.99

Especially in the assembly in which a closure mounts a trigger pump on the top of a container, it is desirable to preclude the inadvertent unscrewing of the closure. In the filling, transport, storage, sale and use of a container having a trigger pump it is relatively easy for the trigger pump to be knocked in a way that tends to unscrew the closure off the container.

Attempts have been made in the past to avoid such inadvertent loosening of the container closure. An example is shown in the U.S. Pat. No. 4,345,691 which issued Aug. 24, 1982 to James E. Burke wherein the finish of the bottle just under the threads is formed with ratchet teeth and the closure is formed on a downward skirt with reverse ratchet teeth below the threads. When the closure is screwed onto the finish, the ratchet teeth engage, snapping successively as the closure is tightened to firmly hold the trigger pump in position.

In addition, there have been other attempts to form means in the molding of the finish or the closure to assure that once tightened, the closure will be difficult to unscrew off of the top of the container. An example is shown in the Baugh patent 3,682,345 wherein the resilient plastic of the finish or of the cap may be formed adjacent the threads with depending triangularly shaped projections which cause the cold flow of the contiguous surface to indent and create a locking effect. Other examples of deforming the threads of the closure cap or the finish of the container are disclosed in the following patents:

2,035,972 Issued Jun. 19, 1980 to Sendel et al
3,376,991 Apr. 9, 1968 Deaver
3,445,022 May 20, 1969 Cilluffo
3,741,421 Jun. 26, 1973 Wittwer
3,888,376 Jun. 10, 1975 Cooke
3,952,899 Apr. 27, 1976 Cooke
3,963,139 Jun. 15, 1976 Gach
3,979,001 Sep. 7, 1976 Bogert
4,007,850 Feb. 15, 1977 Beaugrand
4,053,077 Oct. 11, 1977 DeFelice
4,084,716 Apr. 18, 1978 Bogert
4,139,112 Feb. 13, 1979 Cooke
4,461,394 Jul. 24, 1984 Sendel et al The deformation of the screw threads on the cap has been difficult to achieve. Often the deformation has been made while the threads are still unset and after they have been screwed off the core of the mold.

SUMMARY OF THE INVENTION

The invention is a container-closure assembly comprising a container molded of relatively soft plastic and a closure cap molded of relatively hard plastic and having a top wall and a continuous side wall.

Threads are formed on both the finish of the container and inward on the side wall of the cap. The threads on the cap comprise three threaded segments spaced about the inner circumference of the side wall, the segments include an inward upwardly sloping rib having an upper surface of which is formed with a plurality of wedge-shaped teeth. Each tooth has a front surface sloping upward in the same direction as the rib and at a slightly greater angle, and an abrupt rear face extending down to said inward rib. The intersection of the upper surface and the front face defines a point or line of engagement.

In use, the closure is screwed on to the top of the container finish and the teeth dig onto the underside of the threads on the finish causing the instantaneous elastic deformation of the soft plastic of the finish to anchor the cap against removal. In many embodiments the cap is provided with a central opening which receives the hub of a pump dispenser.

BRIEF DESCRIPTION OF THE DRAWINGS

Other objects and features of the invention will be apparent from the following specification and the drawings, all of which disclose a non-limiting embodiment of the invention. In the drawings.

DESCRIPTION OF THE PREFERRED EMBODIMENTS

Figure 1:
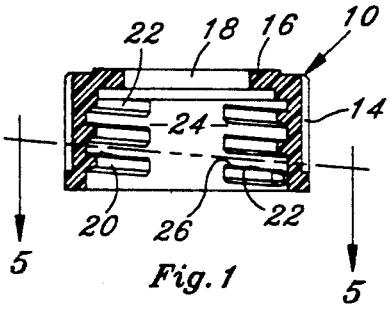
FIG. 1 is a sectional view of a cap embodying the invention.
Figure 2:
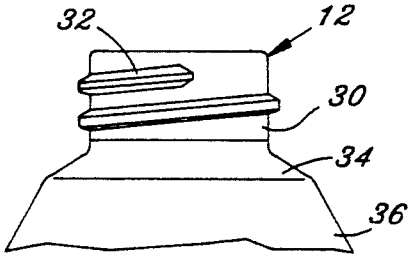
FIG. 2 is a fragmentary profile of a container including a finish adapted to be used with the cap of FIG. 1.

An assembly embodying the invention is shown in unassembled form in FIGS. 1 and 2, the closure or cap body, designated 10 in FIG. 1 and the finish being designated 12 in FIG. 2.

The closure 10 is preferable made of hard plastic such as polypropylene, polyester resin, polycarbonate resin, acetal resin, rigid polyvinyl chloride or acrylonitrile-butadiene styrene resin (ABS). It comprises a continuous side wall 14 attached to a top wall 16 which, in the FIG. 1 embodiment, is only partial, being formed with a central large opening 18. The inside of the side wall 14 is formed with threads generally designated 20 which are in the form of spaced thread segments 22 uniformly spaced about the inner circumference of the side wall. Spaces between the segments are designated 24.

Figure 3:
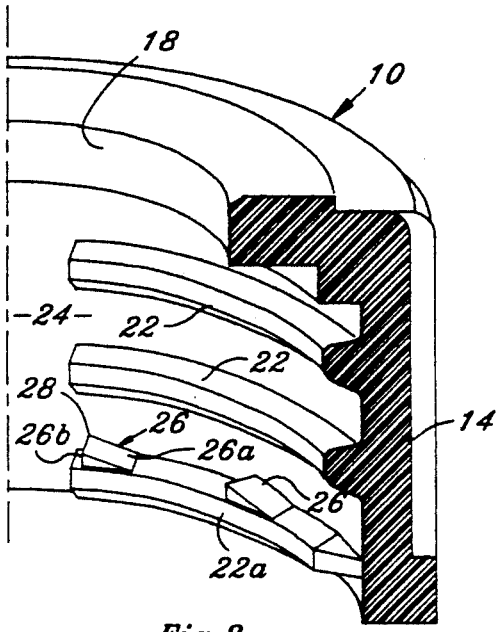
FIG. 3 is a greatly enlarged fragmentary sectional view, in perspective, of the cap of FIG. 1.

The segments 22 take the form of sloping ribs, one spaced over the other and having a complimentary pitch to cooperate with the threads on the finish 12. The lower of the ribs (FIG. 3) is formed with a plurality of wedge-shaped teeth 26 spaced along the top of the rib, as shown. Each of the teeth includes a front surface **26*a* sloping up at an angle slightly greater than that of the rib, and a rear face 26*b* which goes abruptly downward to meet the rib. The intersection of the upper surface and the front face define a point 28** or contact line.

Digression is made here to explain the matter of manufacturing the cap as illustrated in FIG. 1. The prior art has been vague about how to manufacture a cap having saw teeth attached to the threads. In conventional molded cap manufacture the cap is generally unscrewed from a fixed core after the plastic is set. In such arrangement it is clearly not possible to mold teeth or the like onto the surface of the threads.

The present invention is preferably manufactured in a collapsible core mold. One such mold is well disclosed in U.S. Pat. No. 4,938,679 which issued Jul. 3, 1990 to Joseph A. Pietrorazio. In such a mold the core comprises a fixed central part surrounded by a number of reciprocal blades angled to intersect the axis of the fixed central part of the core. Once the molding is complete, the blades may move forward from the fixed central part, carrying the molded cap with them. As they move forward toward the axis, the blades move toward each other making it possible for the cap to be stripped off. It will be understood that the sides of the front of the blades carry the matrices for the thread segments and, in the present instance, also carry the cavities for producing the teeth fixed on the threads. A cap having the spaced thread segments shown in FIG. 1, may thus be readily produced on a collapsible core machine. Another such collapsible core mold is made by a company called D.M.E.

FIG. 2 shows the finish 12 or mouth of the container which is preferably made for use with the invention out of a soft plastic such as polyethylene or polypropylene. It is preferably a blow-molded container wherein threads about the finish are shaped in a separable female mold (not shown).

The finish comprises a cylindrical mouth 30 having a continuous outward thread 32 in the form of a sloping rib thereabout. The cylindrical mouth 30 is integral with sloping shoulders 34 and the body 36 of the container.

As stated, it is important that the cap or closure be hard while the finish be soft. This is all, of course, relative. For example, and from the list of materials above, polypropylene will be soft enough to work well with a hard cap of polycarbonate. That same polypropylene will be hard enough to serve effectively as the material for the cap when the soft finish is polyethylene.

Figure 4:
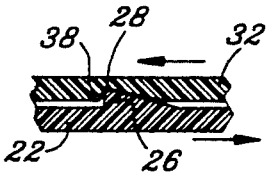
FIG. 4 is an enlarged fragmentary diagramatic sectional view showing the interaction between cap and finish.

In use, the closure 10 is screwed onto the finish 12, the thread segments 20 being of the same pitch as the thread 32 on the finish. As the cap is screwed home, the points 28 or lines of contact of the teeth 26 come into hard contact with the contiguous portions of the thread 32 on the finish and bear upward thereon causing, when the closure is tight, an indentation 38 into the thread (FIG. 4) on the finish.

There is, thus, an immediate or instantaneous elastic deformation of the plastic of the finish. The indentation 38 in the finish, coupled with the wedge shape of the teeth including the abrupt rear faces **26*b* thereof (FIG. 4), virtually defies the removal of the closure from the finish. The immediate deformation may, depending on the natural tendency of the plastic of the thread 32, be enhanced by "cold flow" or "creep". As this phenomenon transpires, the plastic will flow and virtually surround about the point 28 of the teeth 26**, securing the cap further.

Figure 6:
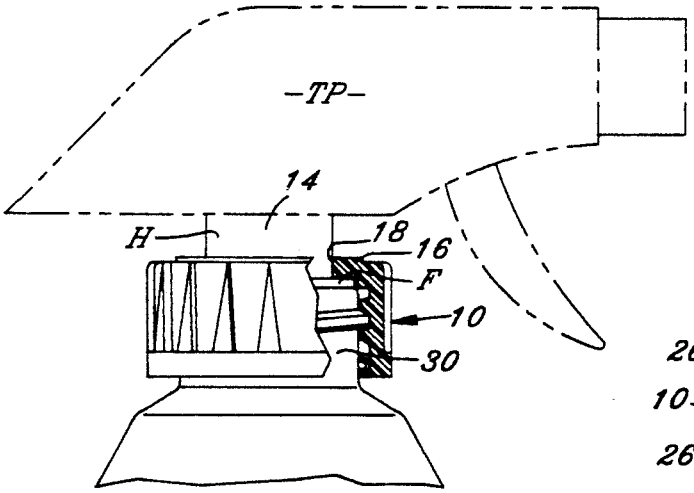
FIG. 6 shows a closure embodying the invention mounted on a finish and supporting a trigger pump, the latter being shown in phantom.
Figure 5:
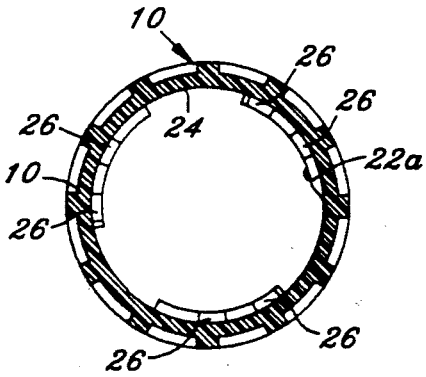
FIG. 5 is a sectional view taken on the line 5—5 of FIG. 1.

As shown in FIG. 6, the opening 18 is dimensioned to receive the hub H of a trigger pump TP. At its lower end, below top wall 16, the cap is provided with a liner (not shown) for the top wall (not shown) to assure a leak-proof connection. When used with the trigger pump TP as shown, the closure 10 is screwed tight as described above and the flange F is clamped firmly between top wall 16 and the top of the finish 12.

The arrangement described has been found effective at assuring the permanency of the installation of the trigger pump TP on the container 12. Clearly, the closure of the invention has other uses wherein the top wall, instead of receiving the hub of a trigger pump, can be continuous and provide a conventional closure for a container offering a tamper-resistant feature.

Generally, the arrangement of the invention is useful in those applications in which ready removal of the closure is not desired. The ease or difficulty of removal of the cap can be engineered empirically by tailoring the shape of the teeth and selecting plastic material of given specification to suit a given application.

Variations in the invention are possible without departing from the spirit of the invention. Thus, while the invention has been shown in only one embodiment, it is not so limited but is of a scope defined by the following claim language which may be broadened by an extension of the right to exclude others from making or using the invention as is appropriate under the doctrine of equivalents.

What is claimed is:

1. A container-closure assembly comprising (a) a container molded of a relatively soft plastic and having an integral finish formed with outward screw threads extending thereabout, and (b) a closure molded of a relatively hard plastic and comprising at least a partial top wall and a continuous side wall having inward threads extending thereabout adapted to threadedly receive the threads on the finish, the threads on the cap comprising a plurality of thread segments uniformly spaced about the inner circumference of the side wall, the segments comprising an inward rib having a sloping upper surface generally perpendicular to the sidewall and having spaced therealong a plurality of inclined wedge-shaped teeth, each having a front face sloping upward in the same direction as the rib and at a slightly greater angle and a generally vertical abrupt rear face descending down to said inward rib, the upper surface and the front face defining a point, whereby when the closure is screwed tightly onto the finish, the points of the teeth dig into the underside of the outward screw threads of the finish to cause the instantaneous elastic deformation of the contiguous plastic of the finish to surround the point and resist the backing off of the closure from the finish.

2. A container-closure assembly as claimed in claim 1 wherein the top wall has a central opening and receives the tubular hub of a dispensing pump, the hub having at its lower end an outward support flange clamped between the underside of the top wall and the top of the finish when the closure is screwed tight.

3. A container-closure assembly as claimed in claim 1 wherein the closure is produced in a collapsible core mold.

4. A container-closure assembly comprising (a) a container molded of a relatively soft plastic selected from the group of plastics consisting of polyethylene, and polypropylene and having an integral finish formed with outward screw threads extending thereabout, and (b) a closure molded of a relatively hard plastic selected from the group of polypropylene, polyester resin, polyethylene terephthalate,, polycarbonate resin, acetal resin, rigid polyvinyl chloride, and acrylonitrile butadiene styrene and comprising at least a partial top wall and a continuous side wall having inward threads extending thereabout adapted to threadedly receive the threads on the finish, the threads on the cap comprising three thread segments uniformly spaced about the inner circumference of the side wall, the segments comprising an inward rib having a sloping upper surface generally perpendicular to the sidewall and having spaced therealong a plurality of inclined wedge-shaped teeth, each having a front surface sloping upward in the same direction as the rib and at a slightly greater angle and a generally vertical abrupt rear face descending down to said inward rib, the meeting of the front surface and the rear face defining a point, whereby when the closure is screwed tightly onto the finish, the points of the teeth dig into the underside of the outward screw threads of the finish to cause the instantaneous elastic deformation of the contiguous plastic of the finish to surround the point and resist the backing off of the closure from the finish.

* * * * *